US010287132B2

(12) United States Patent
Ghazanfari

(10) Patent No.: US 10,287,132 B2
(45) Date of Patent: May 14, 2019

(54) AUTOMATIC NON-CONVEYOR STAIRWAY SYSTEM

(71) Applicant: Hamaye Co, Tehran (IR)

(72) Inventor: Abbas Ghazanfari, Tehran (IR)

( * ) Notice: Subject to any disclaimer, the term of this patent is extended or adjusted under 35 U.S.C. 154(b) by 0 days.

(21) Appl. No.: 15/871,670

(22) Filed: Jan. 15, 2018

(65) Prior Publication Data

US 2018/0244500 A1 Aug. 30, 2018

(51) Int. Cl.
*B66B 21/02* (2006.01)
*B66B 23/12* (2006.01)

(52) U.S. Cl.
CPC ..... *B66B 21/02* (2013.01); *B66B 23/12* (2013.01)

(58) Field of Classification Search
CPC ..... B66B 21/02; B66B 23/12
USPC ..... 198/321, 322
See application file for complete search history.

*Primary Examiner* — Gene O Crawford
*Assistant Examiner* — Lester Rushin, III
(74) *Attorney, Agent, or Firm* — Barry Choobin; Patent 360

(57) ABSTRACT

The embodiments herein provide an automatic non-conveyor stairway comprising two separate straight stair flights that move inside each other without interference. One stair flights moves horizontally. The other stair flight moves vertically. With discrete sequential motion of the stair flights, an arbitrary load is transferred along the stairway. Each stair flights includes several comb-teeth shaped stair steps. The stair steps of horizontal stair flights comprises parallel plates along the stair width attached to a supporting wall at the back. The vertical stair flights include parallel plates fixed at the bottom to a supporting base. The supporting bases are connected to stringer at the left side of the stairs. The supporting walls are fixed to another stringer at the right side. The stringers are confined to move horizontally and vertically, thereby providing the required motion of the stair flights.

11 Claims, 34 Drawing Sheets

AUTOMATIC NON-CONVEYOR STAIRWAY SYSTEM

BACKGROUND

Technical Field

The embodiments herein are generally related to stairways and moving platforms. The embodiments herein are particularly related to an escalator system without conveyor belt. The embodiments herein are more particularly related to an automatic stairway and escalator without conveyor belts.

Description of the Related Art

Automatic stairways (escalators) are advantageous in crowded places to elevate people, where the elevator has limited capacity to carry individuals. Airports and subway stations are good example of the places where escalator are vital to provide an appropriate service for the passengers to prevent crowd.

Existing conventional escalators are comprised of a set of stairs steps that are mounted on a conveyor belt which moves in a loop. The escalator transfers the loads continuously along the stairway and all the existing escalator are based on the concept firstly introduced by Ames.

Existing mooring/docking devices aids in securing a rope or line around a remote object. However, it is typical of such prior art escalators that they are quite complex in construction and operation, relatively expensive to manufacture, and often deficient in the measure of support which they provide for the users/passengers.

In scenarios where a payload needs to be transferred up and down, the conventional escalators cannot be used. Hence, there is need for an improved design of escalator that is used to raise and lower payloads between different floors. Further there is a need for a non-conveyor automatic stairway or stair case for transferring loads along the stairway by discrete sequential motions.

The above mentioned shortcomings, disadvantages and problems are addressed herein and which will be understood by reading and studying the following specification.

OBJECTS OF THE EMBODIMENTS

The primary object of the embodiments herein is to provide a non-conveyor automatic stair which comprises two stair flights for transferring loads along the stairway by discrete sequential motions Another object of the embodiments herein is to provide an automatic escalator to raise or lower payloads between different floors.

Yet another object of the embodiments herein is to provide an automatic escalator including two stair flights.

Yet another object of the embodiments herein is to provide an automatic escalator with stair flights that transfer loads along the stairway by discrete sequential motions.

Yet another object of the embodiments herein is to provide an automatic escalator with a first stair flight and a second stair flight having comb-tooth structure.

Yet another object of the embodiments herein is to provide an automatic escalator without a conveyer belt design.

These and other objects and advantages of the embodiments herein will become readily apparent from the following detailed description taken in conjunction with the accompanying drawings.

SUMMARY

The various embodiments herein provide an automatic escalator to raise or lower payloads between different floors. According to an embodiment herein, the automatic stairway is a non-conveyor stairway comprising two separate stair flights. The two stair flights are designed to move inside each other without interference. Either of the stair flights includes a plurality of comb-teeth shaped stair steps. One stair flights moves forward and backward only along a horizontal direction and the other stair flight moves vertically upward and downward directions. With a discrete sequential motion of the stair flights, an arbitrary load is transferred along the stairway by transforming from one of the stair flights to the other. The two stair flights include a horizontal stair flights and a vertical stair flights. The stair steps of the horizontal stair flights comprise a plurality of parallel plates along the stair width attached to a supporting wall at the back side of the stair step, which forms a comb-teeth structure. The stair steps of the vertical stair flights comprise a plurality of parallel plates that are fixed at the bottom to a supporting base.

According to an embodiment herein, the horizontal stair flights are fixed to a stringer at one side of the stairway and the vertical stair flights are fixed to another stringer at the opposite side of the stair way. There is no interference occurs between the two stringers, thereby providing a required motion for the corresponding stair flights. Thus, one of the stair flights is configured to carry payload in vertical direction and the other stair flights is configured to transfer payload in the horizontal direction. By successive motion of the stair flights, an arbitrary load is transferred along the stairway.

According to an embodiment herein, the supporting base of the horizontal stair flights are connected to stringer at the left side of the stairs and the supporting walls of the vertical stair flights, are fixed to another stringer provided at the right side of the stairs. The stringers are coupled to the stairway in such a manner that one is confined to move horizontally and the other vertically, thereby providing the required motion for the corresponding stair flights.

According to an embodiment herein, an automatic straight stairway or escalator comprises a fixed frame for enclosing a stairs housing. The escalator includes a first stair flight configured to move horizontally, wherein the first stair flight includes a plurality of run stairs. Each run stair comprises a plurality of vertical plates arranged at equal distance along a width of the stair in a comb-tooth structure. The escalator includes a second stair flight configured to move vertically, wherein the second stair flight comprises a plurality of rise stairs. Each of the rise stair comprises a plurality of vertical plates with a comb-tooth structure. Further, the second stair flight is configured to fit inside the first stair flight. The escalator includes a stringer coupled to the fixed frame by linear joints. The stringer is affixed to the plurality of rise stairs, and the stringer is configured to move along a horizontal direction. The escalator further includes a first spring for coupling an uppermost stair step of the first stair flight to other stair steps of the first stair flight. The escalator includes a second spring for coupling a lowermost stair step of the second stair flight to other stair steps of the second stair flight. The second spring is configured to provide a relative vertical motion of the stair steps of the second stair flight. Further, the vertical motion of the second stair flight causes a sequential motion of the first stair flight and the second stair flight, thereby exchanging an arbitrary load between the first stair flight and the second stair flight.

According to an embodiment herein, the stringer in the escalator is configured to move along the horizontal direction using an electric motor and a power transmission mechanism. The plurality of rise stairs are made of several parallel vertical plates that are arranged at equal distances along the width of the stair. The second stair flights is configured to move one or two vertical steps along the vertical direction without interfering and colliding with the first stair flights. The first stair flights is configured to move one or two horizontal steps along the horizontal direction without interfering and colliding with the vertical stair flights. The vertical parallel plates are rectangular in shape with dimension proportional to the size of the rise stair. The height of the vertical plates of the second stair steps is higher than the height of the vertical plates of the first stair steps. The thickness of the vertical parallel plates of the first stair steps are less than a free space between the vertical plates of the second stair steps. The thickness of the vertical parallel plates of the second stair steps are less than a free space between the vertical plates of the first stair steps.

According to an embodiment herein, the stairway comprises safety facilities equipped at the nosing of each of the stair steps and at free spaces between the plurality of vertical plates. The plurality of run stairs and rise stairs are driven though an individual actuator and a control system that controls the sequential motion of stair steps to transfer the loads along the stairway.

According to an embodiment herein, the actuators are replaced with one single actuator and a corresponding power transmission mechanism to actuate both the stair flights. Further, all the stair steps of the horizontal and vertical stair flights are driven via an individual actuator and a control system that controls the sequential motion of the stair steps to transfer loads along the stairway.

According to an embodiment herein, the first spring and the second spring are replaced via a passive or active mechanism to confine the motion of the uppermost/lowermost of either the first stair flight (horizontal) or the second (vertical) stair flights.

According to an embodiment herein, an automatic straight stairway comprises a fixed frame, stairs housing and two stairs flights. The two stairs are horizontal stair flights and vertical stair flights respectively. The vertical stairs flights moves in vertical direction and the horizontal stair flights moves in horizontal direction. The two stair flights are designed to move inside each other without any interference. The horizontal stair flights comprises several number of separate stair steps, namely run stairs. Each of the run stairs is made of several parallel vertical plates that are arranged at equal distance along the width of the stair. The width line of the stair is normal to the vertical plates. The vertical parallel plates are rectangular and have a dimension that is proportional to the size of the run stairs. The vertical plates are rigidly attached to a riser plate at the back of the run stairs.

According to an embodiment herein, all the riser plates of the horizontal stair flights are rigidly attached to a stringer or a carriage at one side. The stringer is constrained to move along the horizontal direction. The stringer is coupled to the stairway frame by linear joints. The stringer is moved along the horizontal direction using an electric motor and a power transmission mechanism.

According to an embodiment herein, the vertical stair flights comprises several number of separate stair steps, namely rise stairs. Each of the rise stairs is made of several vertical plates that are arranged in parallel at equal distance along the width of the stair and the width line of the stair is arranged normal to the vertical plates. The vertical parallel plates are rectangular with a dimension proportional to the size of the rise stair. The vertical plates are rigidly supported by a riser plate at the bottom.

According to an embodiment herein, all the riser plates of the vertical stair flights are rigidly attached to a stringer or a carriage at one side, and opposite to the attachment side of horizontal stair's stringer. The stringer is constraint to move along the vertical direction. The stringer is coupled to the stairway frame by linear joints. The stringer is moved along the vertical direction using an electric motor and a power transmission mechanism.

According to an embodiment herein, the vertical stair flights are moved by one or two vertical steps along the vertical direction without interfering and collision with the horizontal stair flights, when the horizontal stair flights are stationary. When the vertical stair flights are stationary, the horizontal stair flights are moved by one or two horizontal steps along the horizontal direction without interfering and collision with the vertical stair flights. The thickness of the vertical parallel plates of the horizontal stair steps are less than the free space between the vertical plates of the vertical stair steps. Similarly, the thickness of the vertical parallel plates of the vertical stair steps are less than the free space between the vertical plates of the horizontal stair steps, wherein when two stair flights are fully placed inside each other, they form a single stair flights. The height of the vertical plates of the vertical stair steps is a little higher than the height of the vertical plates of the horizontal stair steps and when two stair flights are completely inside each other the upper edge of the vertical stair steps is a bit higher than the corresponding upper edge of the horizontal stair step. Either of the horizontal and vertical stair flights have two type phase of motion, such as a load carrying phase and no-load phase. With the sequential motion of the two stair flights, any arbitrary load is exchanged between the stair flights in the vertical motion of the vertical stair flights.

According to an embodiment herein, the uppermost or the lowermost stair step of the horizontal stair flights has relative horizontal motion with respect to other stair steps of the horizontal stair flights. A spring is provided to couple the uppermost or the lowermost stair to the horizontal stair flights. At the end of backward motion sequence, the uppermost stair collides to the wall of corresponding housing/casing and compresses the spring while its backward motion is decreased by one horizontal step. At the forward motion the spring is expanded and horizontal stair flights return to its normal configuration.

According to an embodiment herein, the lowermost or the uppermost stair step of the vertical stair flights has relative vertical motion with respect to other stair steps of the vertical stair flights. A spring is provided to couple the lowermost stair to the stair flights. For the vertical motion, the spring is neglected. At the end of downward motion sequence, the lowermost stair collides to the wall of corresponding housing/casing and compresses the spring while its downward motion is decreased by one vertical step. At the upward motion, the spring is expanded and horizontal stair flights return to normal configuration.

According to an embodiment herein, the vertical parallel plates are not necessarily flatten rectangular shape and are of any suitable geometrical shape with ragged pattern as long as the configuration and shape ensure the nesting of stair flights.

According to an embodiment herein, the stringers are connected at two sides to the tread plate and riser wall. The stringers at a same side is designed to pass through each other using a suitable mechanism.

According to an embodiment herein, the actuators are replaced with one single actuator and a corresponding power transmission mechanism to actuate both of the stair flights.

According to an embodiment herein, all the stair steps of the horizontal and vertical stair flights are driven via an individual actuator and a control system that controls the sequential motion of the stair steps to transfer loads along the stairway.

According to an embodiment herein, the spring is replaced via a passive or active mechanism to confine the motion of the uppermost/lowermost of both horizontal and vertical stair flights.

According to an embodiment herein, the stair steps are equipped with safety facilities/mechanism at the nosing of the stair steps and the free spaces between the vertical plates.

These and other aspects of the embodiments herein will be better appreciated and understood when considered in conjunction with the following description and the accompanying drawings. It should be understood, however, that the following descriptions, while indicating the preferred embodiments and numerous specific details thereof, are given by way of an illustration and not of a limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
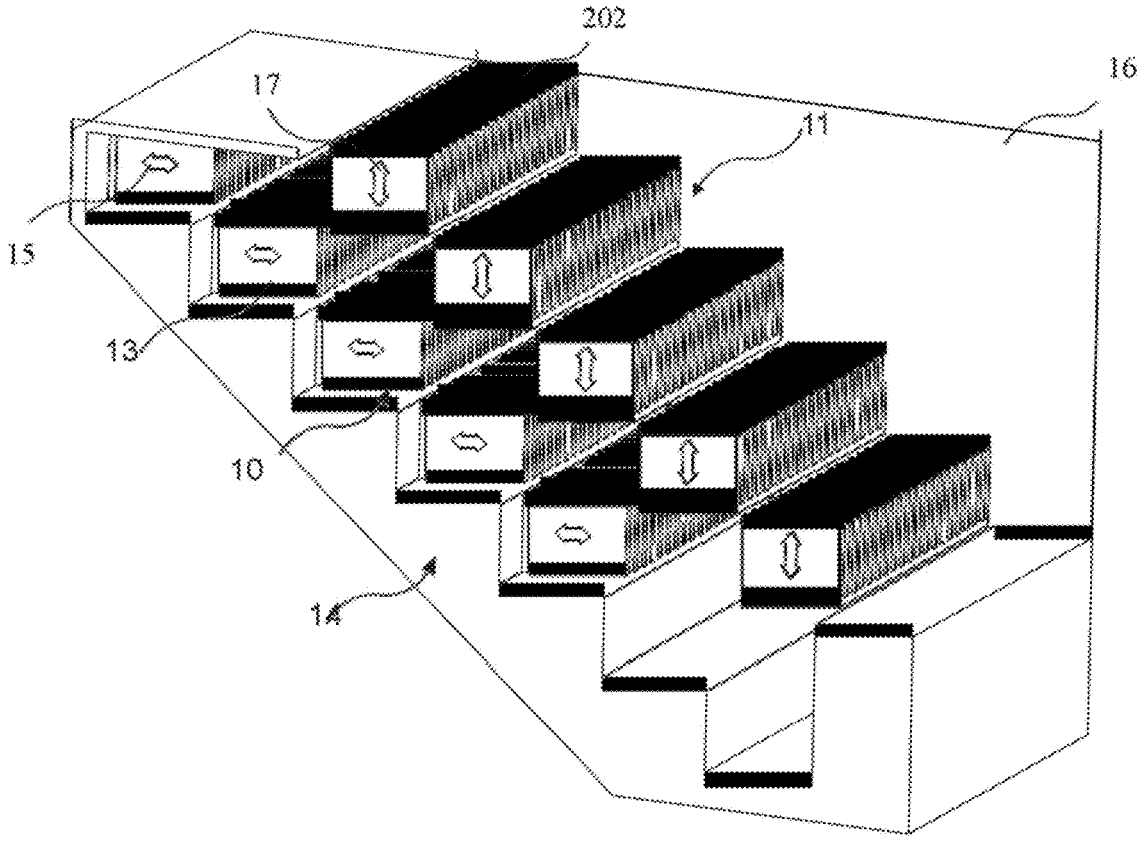
FIG. 1 illustrates a perspective view of an automatic stairway, according to an embodiment herein.

Although the specific features of the embodiments are shown in some drawings and not in others. This is done for convenience only as each feature may be combined with any or all of the other features in accordance with the embodiments.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide an automatic escalator to raise or lower payloads between different floors. According to an embodiment herein, the automatic stairway is a non-conveyor stairway comprising two separate stair flights wherein the stair flights can move inside each other without interference. Either of the stair flights includes a plurality of comb-teeth stair steps. One stair flights moves forward and backward only in horizontal direction while the other stair flight moves vertically upwards and downwards. With the discrete sequential motion of the stair flights, an arbitrary load is transferred along the stairway by transforming from one of the stair flights to the other. The horizontal stair flights are fixed to a stringer at one side of the stairway and the vertical stair flights are fixed to another stringer at the opposite side of the stair way. No interference occurs between the two stringers, thereby providing the required motion for the corresponding stair flights. Thus, one of the stair flights is configured to carry payload in vertical direction while the other stair flights is configured to transfer payload in the horizontal direction. By successive motion of the stair flights, an arbitrary load is transferred along the stairway.

According to an embodiment herein, an automatic straight stairway or escalator comprises a fixed frame for enclosing a stairs housing. The escalator includes a first stair flight configured to move horizontally. The first stair flight includes a plurality of run stairs. Each run stair comprises a plurality of vertical plates arranged at equal distance along the width of the stair in a comb-tooth structure. The escalator includes a second stair flight configured to move vertically. The second stair flight comprises a plurality of rise stairs. Each rise stair comprises a plurality of vertical plates arranged in a comb-tooth structure. Further, the second stair flight is configured to fit inside the first stair flight. The escalator includes a stringer coupled to the fixed frame by linear joints. The stringer is affixed to the plurality of rise stairs. The stringer is configured to move along a horizontal direction. The escalator further includes a first spring for coupling an uppermost stair step of the first stair flight to other stair steps of the first stair flight. The escalator includes a second spring for coupling a lowermost stair step of the second stair flight to other stair steps of the second stair flight. The second spring is designed to provide a relative vertical motion of the stair steps of the second stair flight. Further, the vertical motion of the second stair flight causes a sequential motion of the first stair flight and the second stair flight, thereby exchanging an arbitrary load between the first stair flight and the second stair flight.

According to an embodiment herein, the stringer in the escalator is configured to move along the horizontal direction using an electric motor and a power transmission mechanism. Each rise stair is made of a plurality of parallel vertical plates are arranged at equal distance along a width of the stair. The second stair flights is configured to move one or two vertical steps along the vertical direction without interference and collision with the first stair flights. The first stair flights is configured to move one or two horizontal steps along the horizontal direction without interference and collision with the vertical stair flights. The vertical parallel plates are rectangular in shape with dimension proportional to the size of the rise stair. The height of the vertical plates of the second stair steps is higher than the height of the vertical plates of the first stair steps. The thickness of the vertical parallel plates of the first stair steps are less than a free space between the vertical plates of the second stair steps. The thickness of the vertical parallel plates of the second stair steps are less than a free space between the vertical plates of the first stair steps.

According to an embodiment herein, the stairway comprises safety facilities or mechanism or system equipped at the nose/edge of each of the stair steps and at free spaces between the pluralities of vertical plates. The plurality of run stairs and rise stairs are driven though an individual actuator and a control system that controls the sequential motion of stair steps to transfer the loads along the stairway. According to an embodiment herein, the actuators are replaced with one single actuator and a corresponding power transmission mechanism to actuate both the stair flights. Further, all the stair steps of the horizontal and vertical stair flights are driven via an individual actuator and a control system that regulates the sequential motion of the stair steps to transfer loads along the stairway.

According to an embodiment herein, the first spring and the second spring are replaced via a passive or active mechanism to confine the motion of the uppermost/lowermost of both the first stair flight (horizontal) and the second (vertical) stair flights.

According to an embodiment herein, an automatic straight stairway comprises a fixed frame, stairs housing and two stairs flights. The two stairs are horizontal stair flights and vertical stair flights respectively. The vertical stairs flights moves in vertical direction and the horizontal stair flights moves in horizontal direction. The two stair flights are designed to move inside each other without any interference. The horizontal stair flights comprises several number of separate stair steps, namely run stairs. Each of the run stairs is made of several parallel vertical plates that are arranged at equal distance along the width of the stair. The width line of the stair is normal to the vertical plates. The vertical parallel plates are rectangular and have a dimension that is proportional to the size of the run stairs. The vertical plates are rigidly attached to a riser plate at the back of the run stairs.

According to an embodiment herein, all the riser plates of the horizontal stair flights are rigidly attached to a stringer or a carriage at one side. The stringer is constrained to move along the horizontal direction. The stringer is coupled to the stairway frame by linear joints. The stringer is moved along the horizontal direction using an electric motor and a power transmission mechanism.

According to an embodiment herein, the vertical stair flights comprises several number of separate stair steps, namely rise stairs. Each of the rise stairs is made of several vertical plates that are arranged in parallel at equal distance along the width of the stair and the width line of the stair is arranged normal to the vertical plates. The vertical parallel plates are rectangular with a dimension proportional to the size of the rise stair. The vertical plates are rigidly supported by a riser plate at the bottom.

According to an embodiment herein, all the riser plates of the vertical stair flights are rigidly attached to a stringer or a carriage at one side, and opposite to the attachment side of horizontal stair's stringer. The stringer is constraint to move along the vertical direction. The stringer is coupled to the stairway frame by linear joints. The stringer is moved along the vertical direction using an electric motor and a power transmission mechanism.

According to an embodiment herein, the vertical stair flights are moved by one or two vertical steps along the vertical direction without interfering and collision with the horizontal stair flights, when the horizontal stair flights are stationary. When the vertical stair flights are stationary, the horizontal stair flights are moved by one or two horizontal steps along the horizontal direction without interfering and collision with the vertical stair flights. The thickness of the vertical parallel plates of the horizontal stair steps are less than the free space between the vertical plates of the vertical stair steps. Similarly, the thickness of the vertical parallel plates of the vertical stair steps are less than the free space between the vertical plates of the horizontal stair steps, wherein when two stair flights are fully placed inside each other, they form a single stair flights. The height of the vertical plates of the vertical stair steps is a little higher than the height of the vertical plates of the horizontal stair steps and when two stair flights are completely inside each other the upper edge of the vertical stair steps is a bit higher than the corresponding upper edge of the horizontal stair step. Either of the horizontal and vertical stair flights have two type phase of motion, such as a load carrying phase and no-load phase. With the sequential motion of the two stair flights, any arbitrary load is exchanged between the stair flights in the vertical motion of the vertical stair flights.

According to an embodiment herein, the uppermost or the lowermost stair step of the horizontal stair flights has relative horizontal motion with respect to other stair steps of the horizontal stair flights. A spring is provided to couple the uppermost or the lowermost stair to the horizontal stair flights. At the end of backward motion sequence, the uppermost stair collides to the wall of corresponding housing/casing and compresses the spring while its backward motion is decreased by one horizontal step. At the forward motion the spring is expanded and horizontal stair flights return to its normal configuration.

According to an embodiment herein, the lowermost or the uppermost stair step of the vertical stair flights has relative vertical motion with respect to other stair steps of the vertical stair flights. A spring is provided to couple the lowermost stair to the stair flights. For the vertical motion, the spring is neglected. At the end of downward motion sequence, the lowermost stair collides to the wall of corresponding housing/casing and compresses the spring while its downward motion is decreased by one vertical step. At the upward motion, the spring is expanded and horizontal stair flights return to normal configuration.

According to an embodiment herein, the vertical parallel plates are not necessarily flatten rectangular shape and are of any suitable geometrical shape with ragged pattern as long as the configuration and shape ensure the nesting of stair flights.

According to an embodiment herein, the stringers are connected at two sides to the tread plate and riser wall. The stringers at a same side is designed to pass through each other using a suitable mechanism.

According to an embodiment herein, the actuators are replaced with one single actuator and a corresponding power transmission mechanism to actuate both of the stair flights.

According to an embodiment herein, all the stair steps of the horizontal and vertical stair flights are driven via an individual actuator and a control system that controls the sequential motion of the stair steps to transfer loads along the stairway.

According to an embodiment herein, the spring is replaced via a passive or active mechanism to confine the motion of the uppermost/lowermost of both horizontal and vertical stair flights.

According to an embodiment herein, the stair steps are equipped with safety facilities/mechanism at the nosing of the stair steps and the free spaces between the vertical plates.

FIG. 1 illustrates a perspective view of an automatic stairway, according to an embodiment herein. With respect to FIG. 1, the automatic stairway of the present invention has the first stair flight 10, the second stair flight 11, the stairway frame 16 and the stair flights housing 14. The number of stairs is provided in accordance with the total run distance and total height required for the stairway. The first stair flight 10 is configured to move in the horizontal direction which is further referred to as horizontal stair flight 10. The second stair flight 11 is configured to move in vertical direction, and referred to as vertical stair flights 11. The stair flights 10, 11 are motorized using suitable actuation and the related power transmission mechanism. All the stair steps 13 of the horizontal stair flights 10 are rigidly attached to each other and move simultaneously with each other along the horizontal direction shown by the arrow 15. Similarly, all the stair steps 12 of the vertical stair flights 11 are rigidly attached to each other and move simultaneously along the vertical direction 16. According to an embodiment herein, the horizontal stair flight 10 carries the payload along the run of the stairway. Each stair step of the horizontal stair flight 10 is referred as "run stair" 13. Each stair step of the vertical stair flight 11 that carries payloads along the stairway is referred as the "rise stair" 12. Both the rise stairs 12 and the run stairs 13 are made of a plurality of parallel plates with a comb-teeth structure. The dimensions of the run stair and rise stair are approximately similar and are based on the standards for conventional stairway or escalators. The run stairs 13 are designed to enclose or encompass the rise stairs 12 so that the run stairs and rise stairs lie completely inside each other. When the stair flights are fully reside or arranged inside each other, both the stair flights are configured to form a single stairway in the same in any conventional non-automatic stairway. By discrete sequential motion of the vertical and horizontal stair flights, an arbitrary payloads is transferred along the stairway. The horizontal stair flights have two sequential horizontal movements along forward and backward directions, while the vertical stair flights have two vertical movements along upward and downward directions. Any one of the sequential movements such as forward, backward, downward and upward movements has two different phases, known as a load carrying phase and a no-load movement/phase. In the load carrying phase, the stair flights are designed to carry the payloads. In no-load phase, the stair flights proceed to make the other stair flights carry load without collision between the stair flights. The stairway housing 14 is designed to enclose or accommodate the form of stair flights 10, 11. The housing is designed to provide the required space for the stair flights 10, 11 to enclose and accommodate both the stair flights completely inside the hosing without collision.

FIG. 2 illustrates one run stair 201 of the horizontal stair flights 10. The isometric view, side view, front view and top view of the stair 201 are shown in the FIG. 2-A, FIG. 2-B, FIGS. 2-C and 2-D respectively. Each constitutive stair step of the horizontal stair flights are referred as run stair 201, herein. The run stair 201 comprises a set of parallel plates 202 with a specified thickness 203 fixed to a rigid base, referred to as the riser plate 205, with an equal distance 204 between the two adjacent plates. Contrary to the riser of the conventional stairs which are at the front side of stairway, the riser plate is provided at the back side of the stair. The run stair has a width 206, height 208 and length 207. The parallel plates 202 with the length 209, depth of 210 and thickness of 203, are all fixed rigidly to the riser plate 205 with the thickness of 211 provided at the back of the stair 201. The height and width of the parallel plates 202 of the run stair are approximately equal to height and depth of the run stair itself.

Figure 2A:
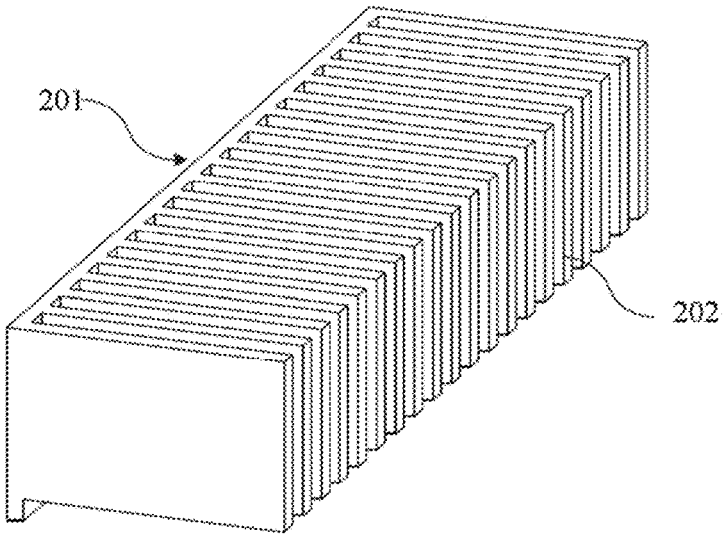
FIG. 2A illustrates an isometric view of a run stair of the horizontal stair flight, according to an embodiment herein.
Figure 2B:
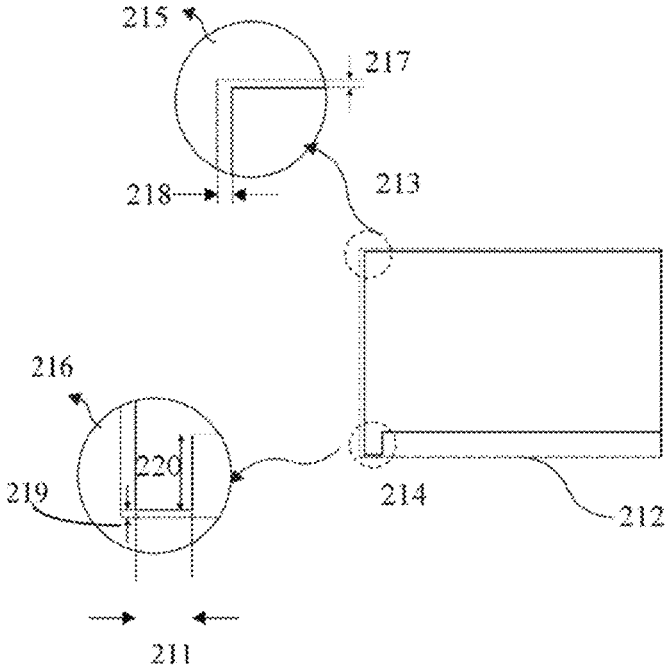
FIG. 2B illustrates a side view of a run stair of the horizontal stair flight, according to an embodiment herein.
Figure 2C:
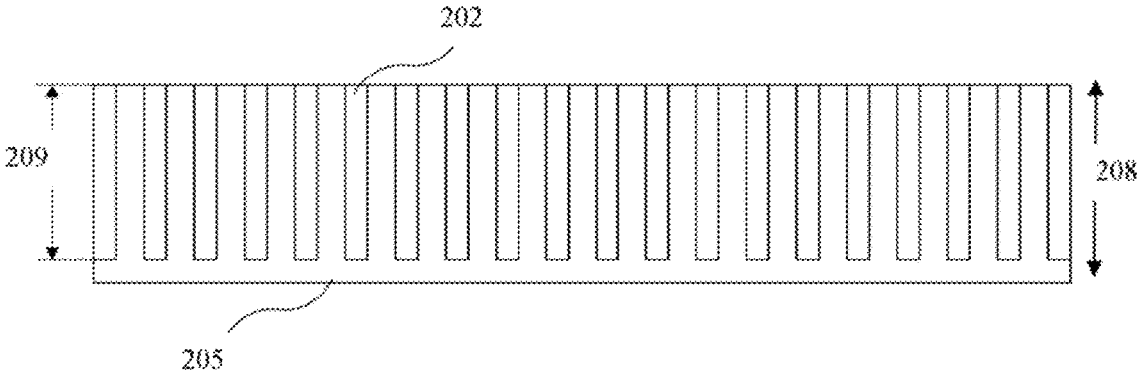
FIG. 2C illustrates a front view of a run stair of the horizontal stair flight, according to an embodiment herein.
Figure 2D:
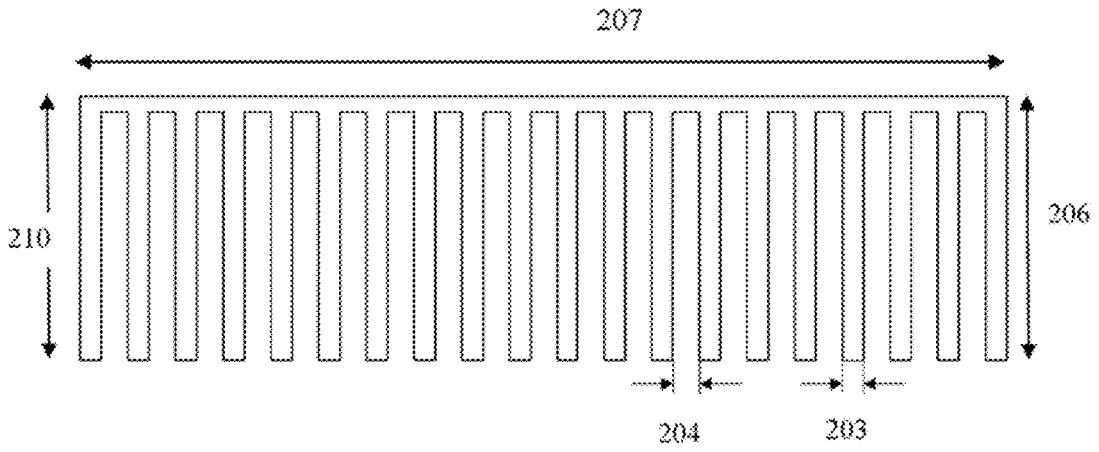
FIG. 2D illustrates a top view of a run stair of the horizontal stair flight, according to an embodiment herein.
Figure 3A:
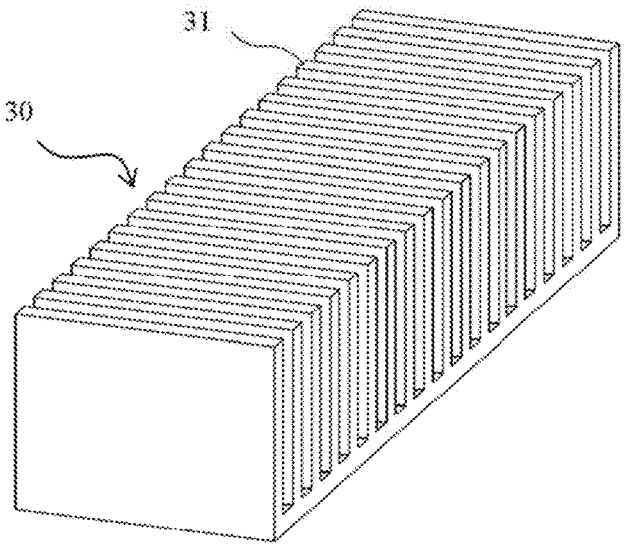
FIG. 3A illustrates an isometric view of a rise step of the vertical stair flight, according to an embodiment herein.
Figure 3B:
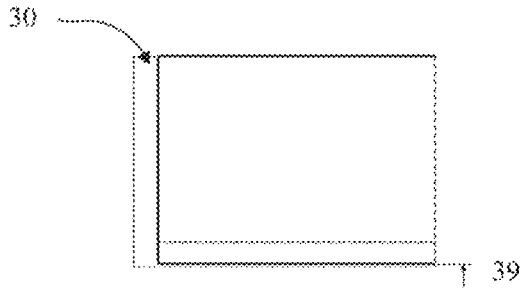
FIG. 3B illustrates a side view of a rise step of the vertical stair flight, according to an embodiment herein.
Figure 3C:
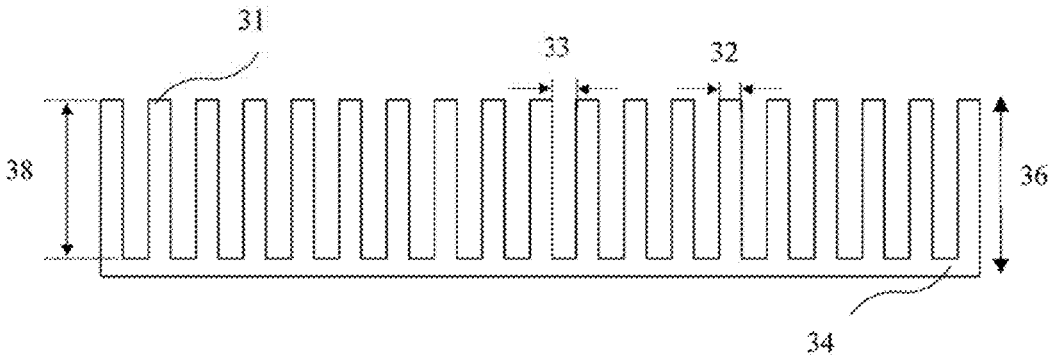
FIG. 3C illustrates a front view of a rise step of the vertical stair flight, according to an embodiment herein.
Figure 3D:
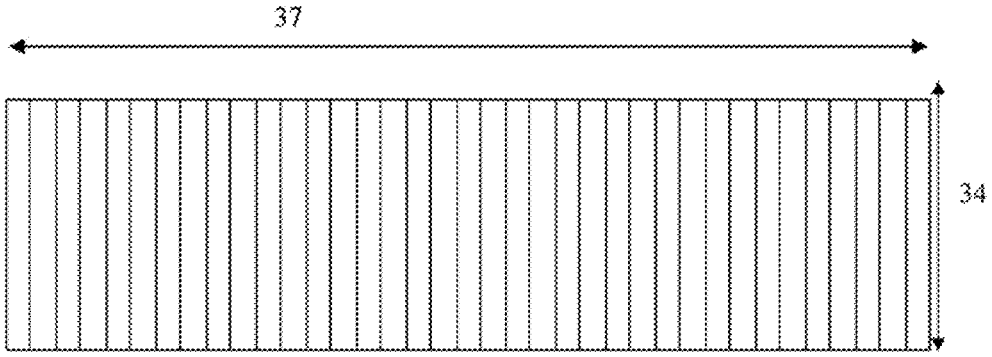
FIG. 3D illustrates a top view of a rise step of the vertical stair flight, according to an embodiment herein.

According to an embodiment herein, a tolerance limit is provided to meet to prevent any interference between the run stairs 201 with the corresponding hosing 212. The tolerance limit between the run stairs 201 and stair hosing 212 is shown in FIG. 2B. The section 213 and 214 are enlarged for a detailed representation of the tolerances in FIG. 2B. The magnified views of this sections 213 and 214 are shown in 215 and 216 respectively. The distance 217 between the uppermost edge of the housing and the stair, and the distance 218 between the back of the stair 201 with the stair housing are shown in the enlarged section 215. As shown in 216, the lowermost edge of the stair 201 which is the bottom edge of the riser plate has a distance of 219 with the housing 212.

The height of the riser plate is more than that of the vertical plates 202 by the distance of 220.

FIG. 3 illustrates one rise step 30 of the vertical stair flights 11. The isometric view, side view, front view and top view of the stair 30 are shown in the FIG. 3A, FIG. 3B, FIG. 3C and FIG. 3D respectively. Each constitutive stair step of the vertical stair flights is referred as rise stair 30, herein. Any riser stair 30 comprises a set of parallel plates 31 with a specified thickness 32, that are rigidly attached to a rigid base, referred to as the tread plate 34, with an equal distance 33, at the bottom. The horizontal stairs has a height 36, width 35 and length 37. The parallel plates 31 with the height 38, length 35 and thickness 32 are attached rigidly to a thread plate 34 with the thickness 39 provided at the bottom. To prevent any interference with the corresponding housing 212 and the horizontal stair steps in the sequential motion of the stair flights, a tolerance limit is provided and the tolerances between the rise stair 30 and stair housing 212.

Figure 4A:
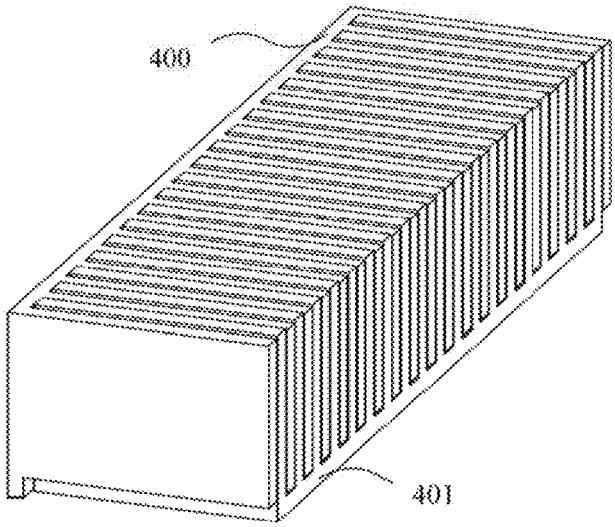
FIG. 4A illustrates an isometric view of stair steps of the first stair flight and stair steps of the second stair flight with their parallel plates nested inside each other, according to an embodiment herein.
Figure 4B:
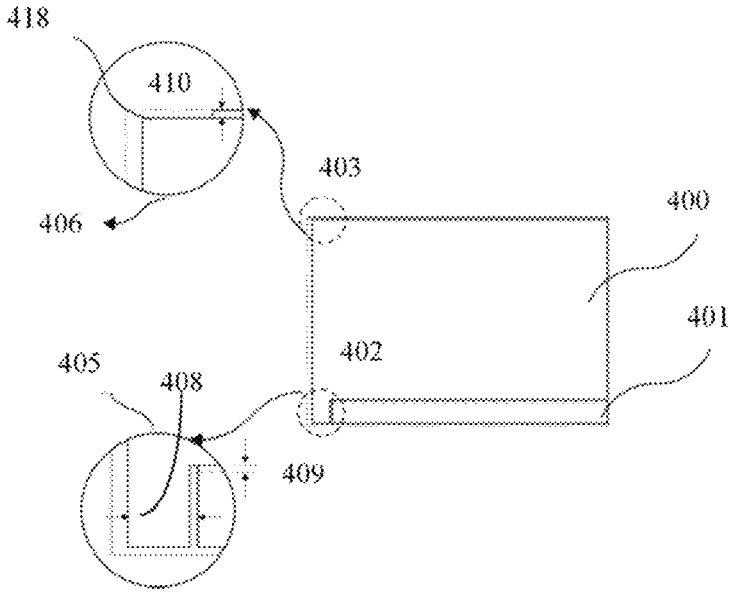
FIG. 4B illustrates a front view of stair steps of the first stair flight and stair steps of the second stair flight with their parallel plates nested inside each other, according to an embodiment herein.
Figure 4C:
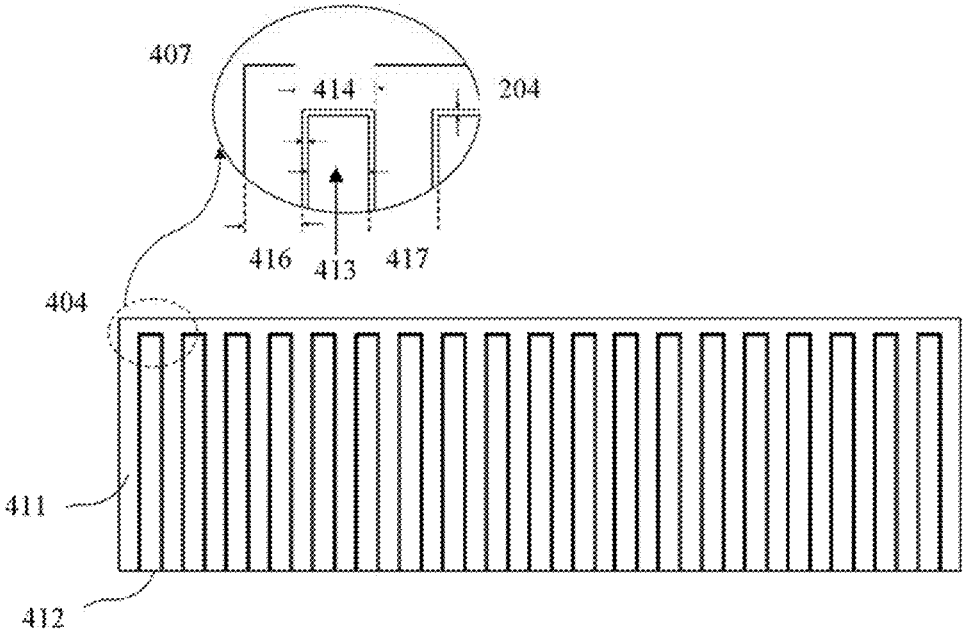
FIG. 4C illustrates a top view of stair steps of the first stair flight and stair steps of the second stair flight with their parallel plates nested inside each other, according to an embodiment herein.

FIG. 4A, FIG. 4B and FIG. 4C illustrate stair steps 400 of the first stair flight and stair steps of the second stair flight 401 with their parallel plates nested inside each other. The horizontal stair flights of the first stair has a flight stair step 400 and the vertical stair flights of the second stair flight has the stair step 401. The isometric view, front, and top view of the two stair step are shown in FIG. 4A, FIG. 4B, and FIG. 4C respectively. Referring to the FIG. 4A-FIG. 4C, the total dimension of the two nested stair is approximately equal to the size of either stairs.

In FIG. 4A, the two stair steps 400, 401 are completely nested or arranged inside each other and a tolerance limit is provided to prevent any possible interference between the corresponding stair steps during a sequential motion or movement of the stairs. The related tolerance between two stair steps is shown in FIG. 4B and FIG. 4C in the enlargement of the sections 402, 403 and 404 shown in 405, 406 and 407 respectively. The depth 35 of the rise stair 401 is less than the depth of the parallel plate of the run stair 202 and is shown by 408 in the magnified view in section 405. The tolerance 409 is the free space between the lowermost side of the parallel plates 202 of the run stair and the upper side of the tread plate 34 of the corresponding rise stair. For exchange of the payload between two stair steps, the uppermost side of the rise stair is greater than the uppermost side 418 of the run stair as shown by 410. Considering an equal dimensions for the thickness and the free space between the vertical plates for run stairs and rise stairs, for the nesting of two corresponding stair steps and their movement through each other, the thickness 413 of the parallel plates of the rise stair step is less than the free space 414 between the two adjacent plates of the run stair with the tolerance 415 at either side and the thickness of the plates of the run stair is less than the free space between two adjacent plate of the rise stair.

Figure 5:
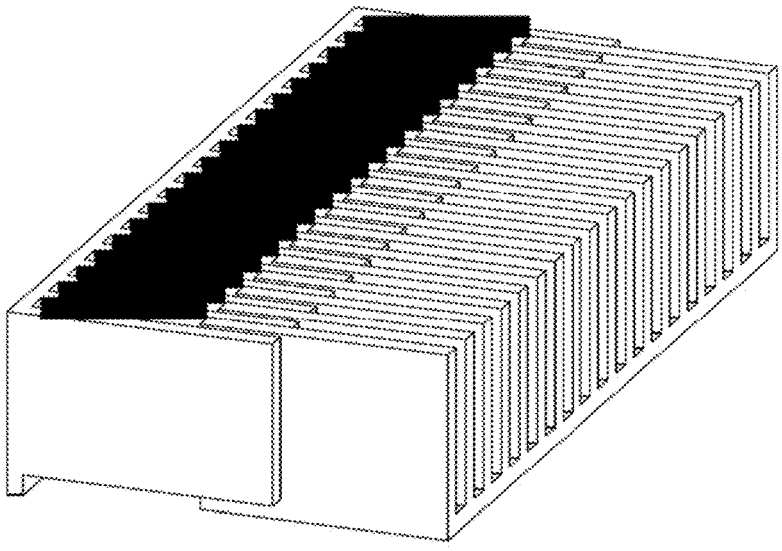
FIG. 5 illustrates a perspective view of a horizontal stair flight indicating a horizontal motion, according to an embodiment herein.
Figure 6:
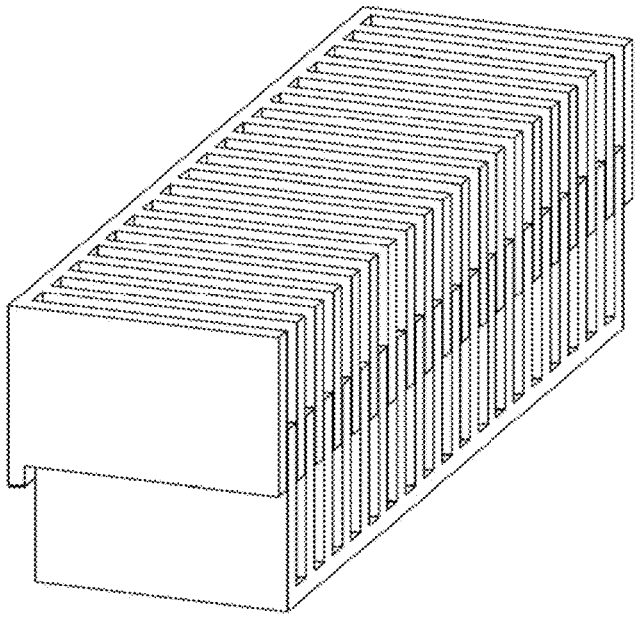
FIG. 6 illustrates a perspective view of a vertical stair flight indicating a vertical motion of two stair steps with respect to each other, according to an embodiment herein.
Figure 7:
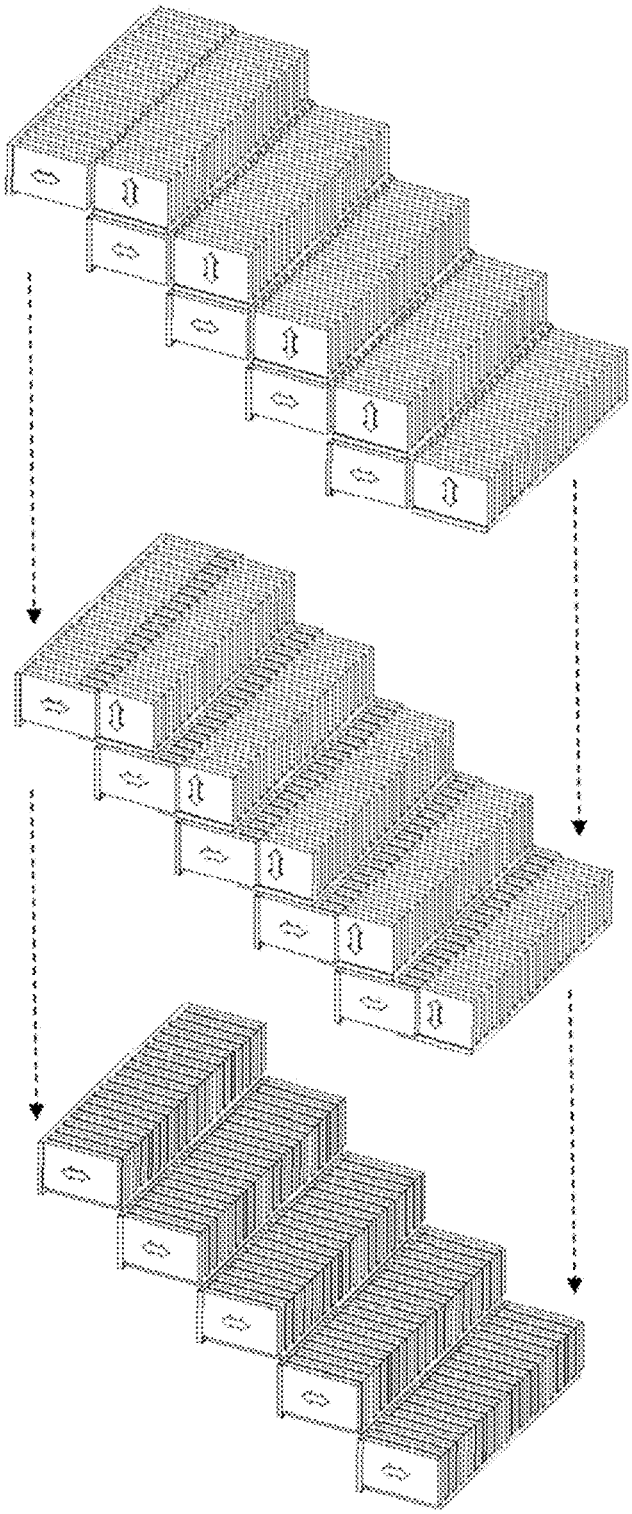
FIG. 7 illustrates a perspective view of an automatic stair way indicating the sequential motion of the first stair flight and the second stair flight with respect to each other, according to an embodiment herein.
Figure 8:
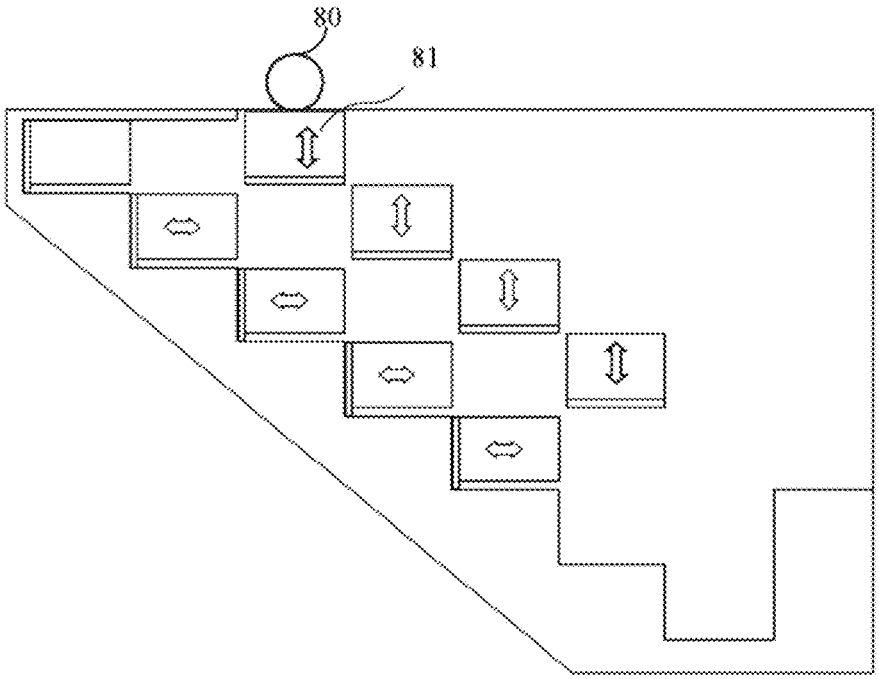
FIG. 8, FIG. 9, FIG. 10, FIG. 11, FIG. 12, FIG. 13, FIG. 14, FIG. 15, FIG. 16, FIG. 17, and FIG. 18 illustrate a side view of an automatic stair way indicating the sequential motion of the first stair flight and the second stair flight with an arbitrary spherical object as the payload, according to an embodiment herein.

FIG. 5 illustrates the horizontal motion of two stair steps with respect to each other. FIG. 6 illustrates the vertical motion of two stair steps with respect to each other. FIG. 7 illustrates the sequential motion of the first stair flight and the second stair flight with respect to each other.

According to an embodiment herein, the automatic stair way transfers an arbitrary load by a discrete sequential motion of the vertical and horizontal stair flights. The sequential motion of the invention has a special logic and in each sequence of the motion, just one stair flight is in motion. The stair fight is in a no-load phase or load carrying phase. The motion/movement of the vertical stair flights is in upward and downward directions while the horizontal stair flights has a motion/movement in two sequences, in forward and backward directions. Depending on the lowering and raising the load along the stair way, the horizontal stair flights carry payload in the backward or forward sequence/movements while the vertical stair flights carry load in the upward or downward sequence/movements. At the end of load carrying sequence of the stairs, the payload is transferred to the other stair which then carries the load at normal direction to the previous motion/movement direction.

FIG. 8-FIG. 18 illustrate the sequential motion of the first stair flight and the second stair flight with an arbitrary spherical object 80 as the payload. The motion/movement of horizontal stair flights to one length of stair depth is called horizontal step and the motion/movement of the vertical stair flight to one length of stair height is called one vertical step. For description of the sequential motion/movement and load transfer along the stair way, the load 80 is transferred from the top of the stairway to the bottom, in which the initial sequence starts with the payload on the uppermost rise stair of the vertical stair flights. It is to be noted that the provided sequential motion is just an example and other sequential motion/movements are also be provided according to this principle described in this invention.

Figure 9:
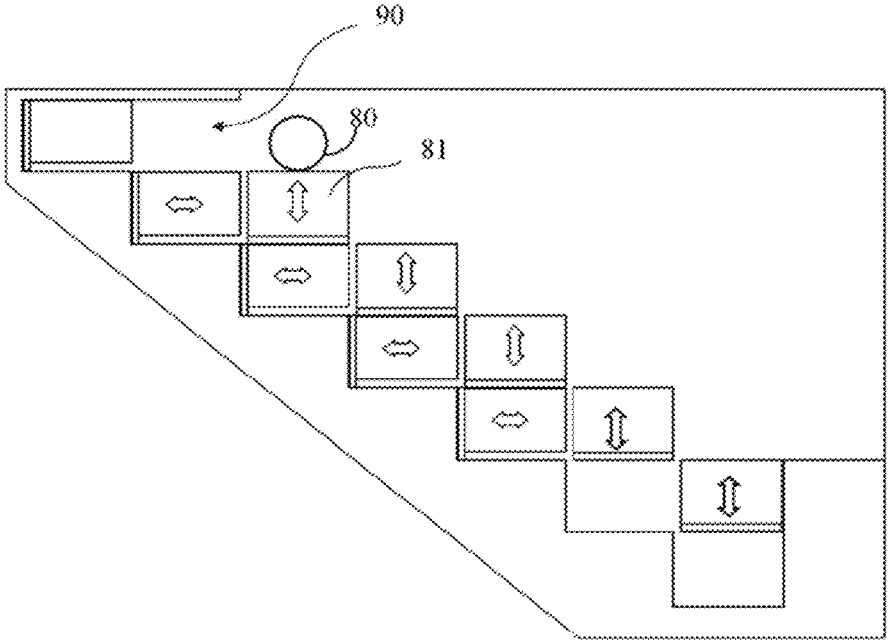
Figure 10:
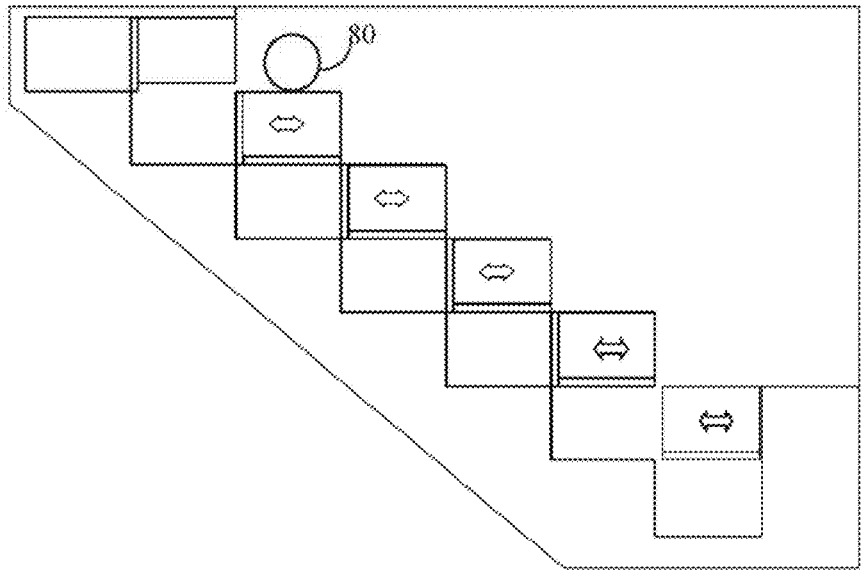
Figure 11:
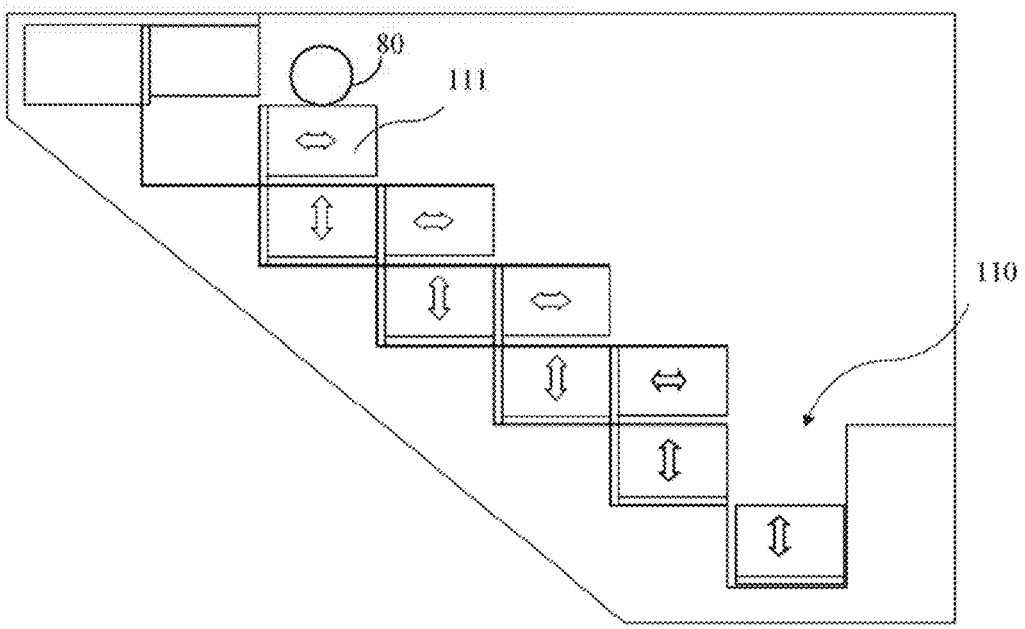
Figure 12:
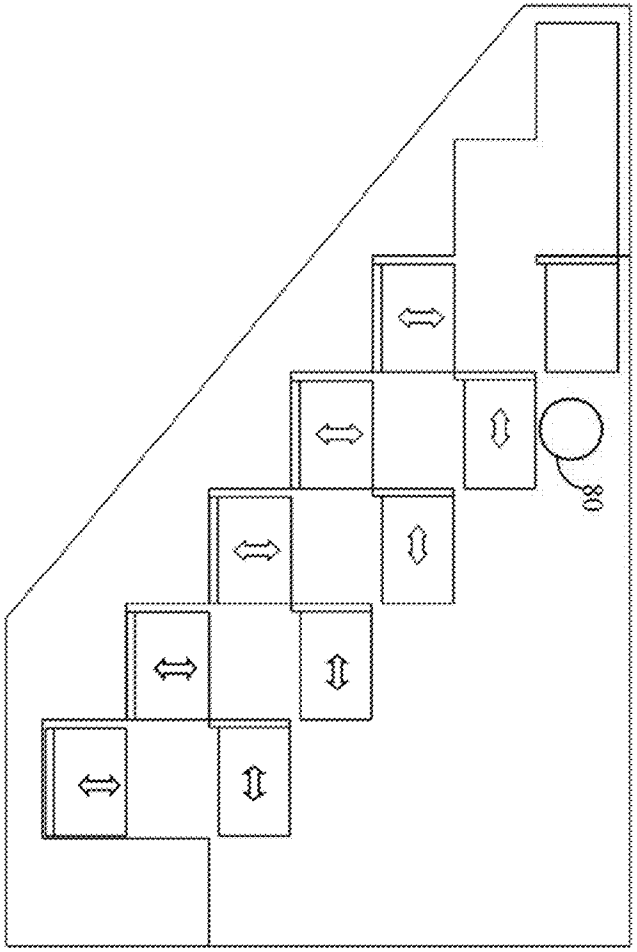
Figure 13:
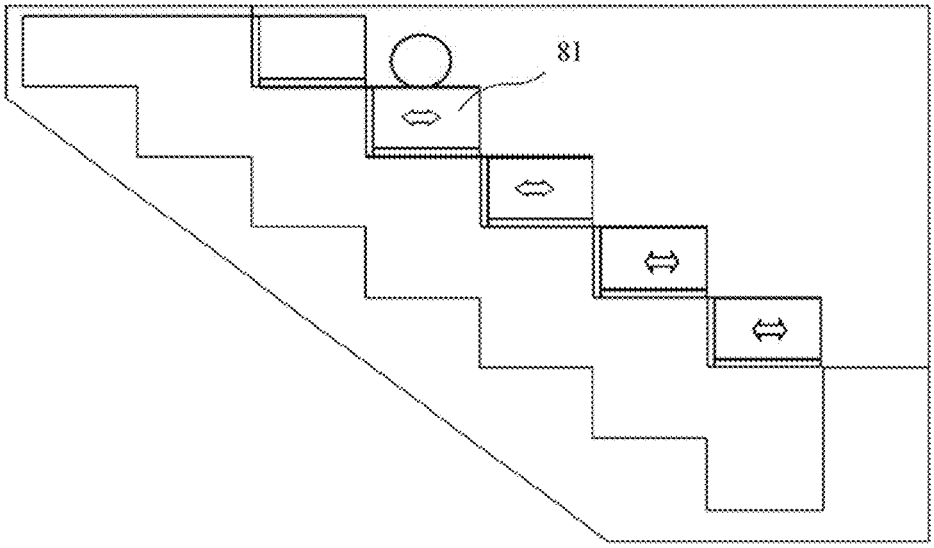
Figure 14:
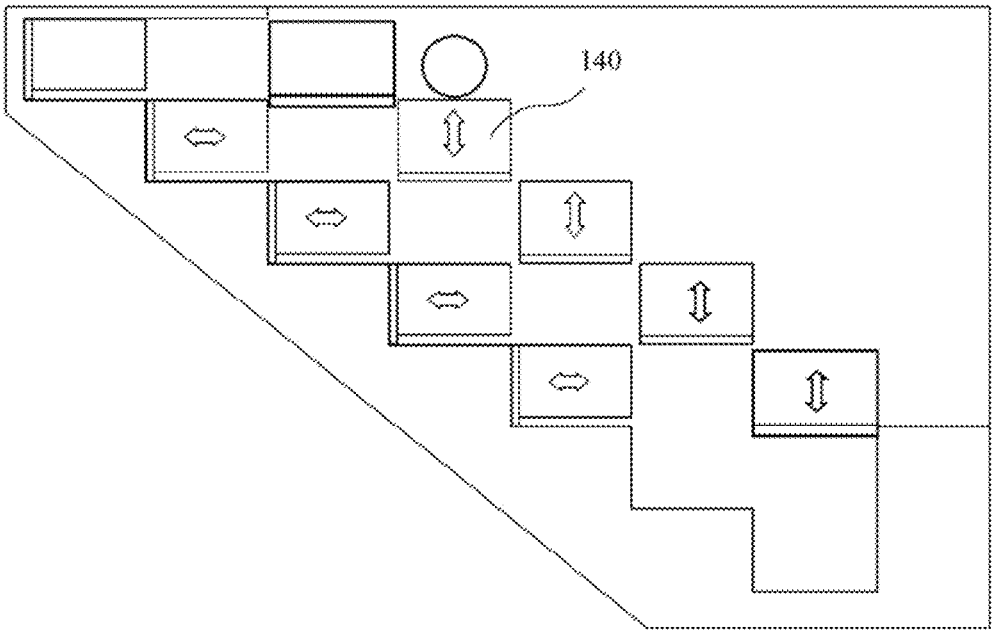

According to an embodiment herein, an arbitrary load 80 at the uppermost rise stair 81 of the vertical stair flights, in the first sequence of the motion/movement, the load is carried downward one vertical step in FIG. 9. In this sequence, the horizontal stair flights is in stationary phase. At the second sequence, the horizontal stair flights moves forward in one horizontal step and the vertical stair flights is in stationary phase while the two stair flights nest inside each other, and the load is still in the vertical stair flights, as shown in FIG. 10. In the third sequence, as shown in FIG. 11, the vertical stair flights are designed to maintain one vertical step downwards and the payload is transferred to the second uppermost run stair 111 of the horizontal stair flights. It is to be noted that the dimension of the payload is too large enough to pass through the free spaces between the parallel plates of the run stair and rise stair. The payload is positioned on the run stair 111 and the horizontal stair flights makes one horizontal step forward in the fourth sequence, as shown in FIG. 12. In the fifth sequence, the vertical stair flights moves two vertical step upward and the stair flights nest inside each other, as shown in FIG. 13 and the load is transferred to the vertical stair flights. At this sequence, the load is positioned on the second uppermost stair 140 of the vertical stair flights, as shown in FIG. 14. In the sixth sequence, the horizontal stair flights makes two backward movements in horizontal direction as shown in FIG. 14. The aforementioned sequences are repeated successively to transfer the payload to the bottom of the stairway which is shown in FIG. 15-FIG. 18.

Figure 15:
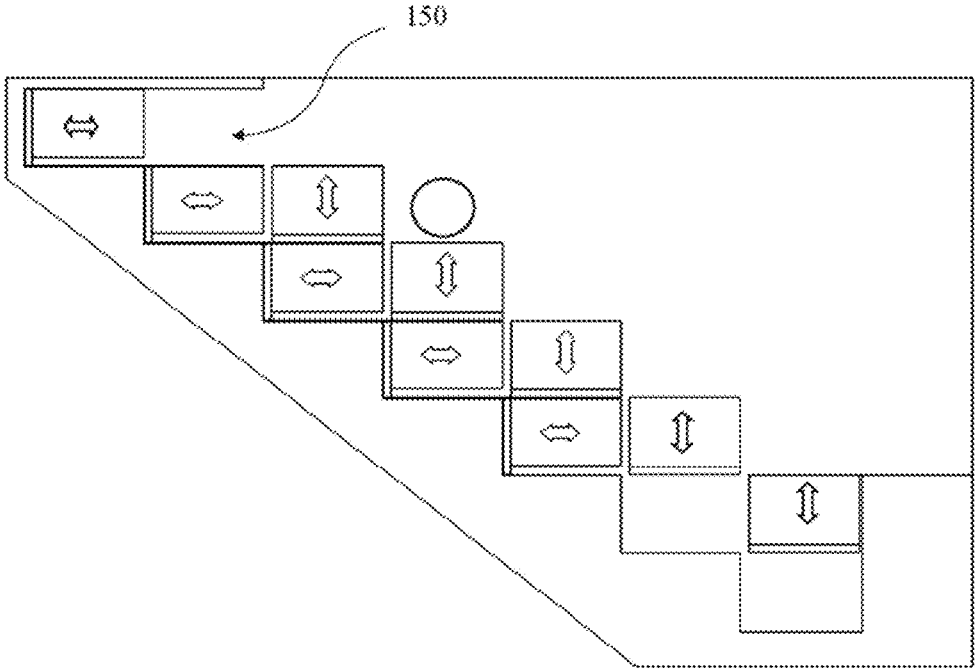
Figure 16:
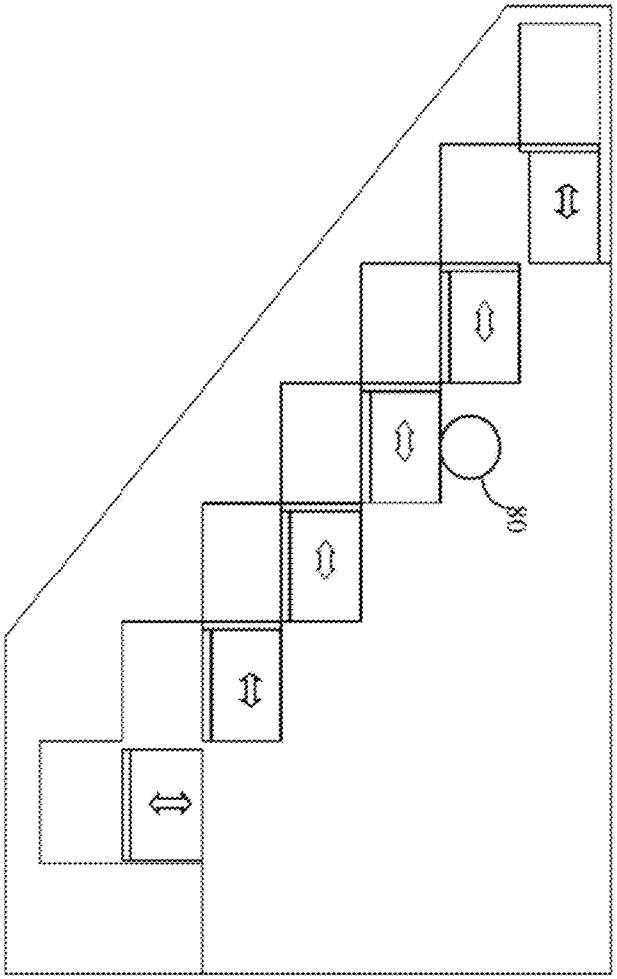
Figure 17:
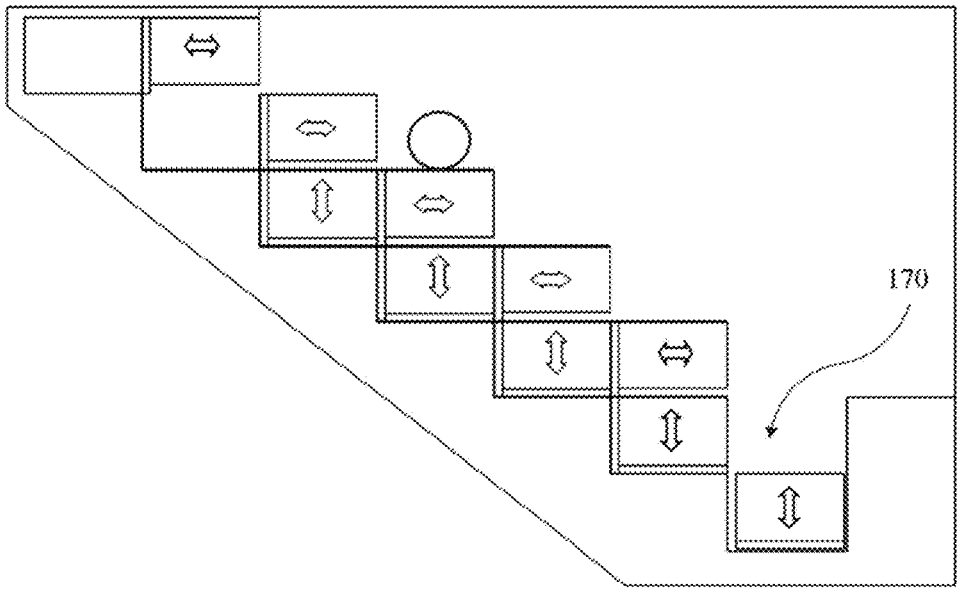
Figure 18:
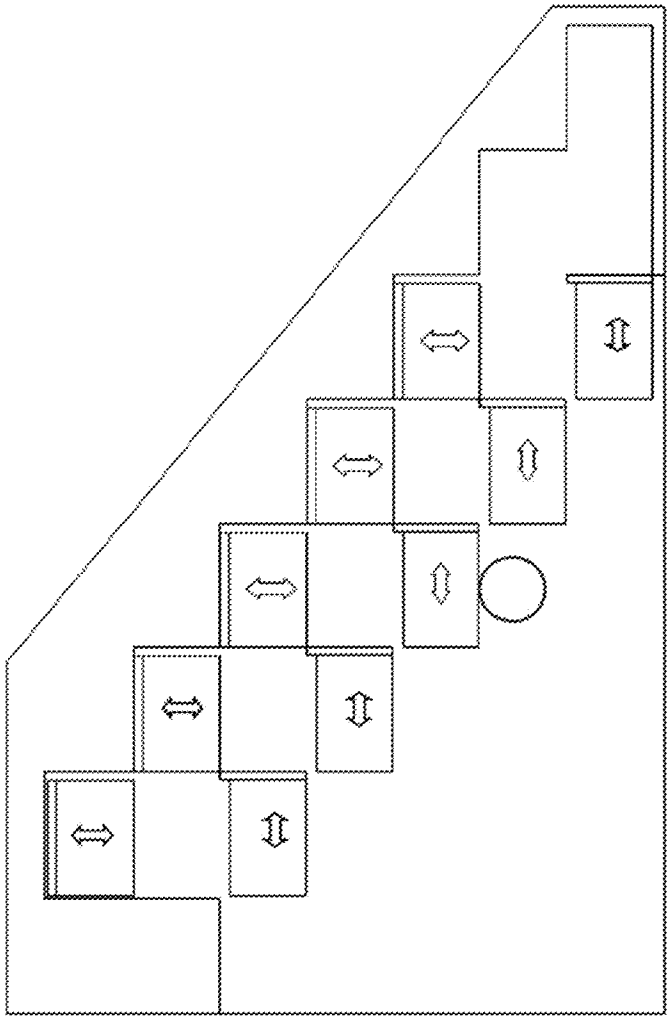

Referring to the FIG. 9, a void space 90 occurs at the stairway in this sequence and the void space 150 is then repeated as shown in FIG. 15 at the uppermost housing. The other void space 110 occurs at the stairway which is repeated as 170 in FIG. 17 at the lowermost casing which we refer to as vertical void 110,170. For safety affair, it is preferable to provide a suitable solution for void avoidance is provided at the stairway. At the following, a sample solution is provided to prevent the void spaces at the stairway. It is to be noted that the following procedure is just one example of the numerous solutions provided to prevent void spaces and skilled one in the art can propose other mechanism for void avoidance. The solution provided here is to limit the downward and backward motion/movement of the corresponding rise and run stair at the void in housing. In the embodiment shown in FIG. 1, the void space occurs at the lowermost housing of the rise stair as well as the uppermost housing of the run stair but the void space is designed to correspond differently to the stairs according to the initial configuration of the stairs flights and stairway housing.

Figure 19:
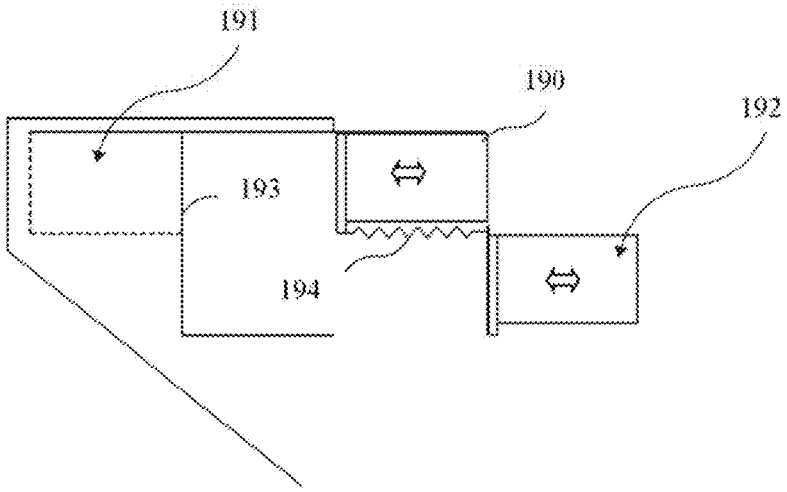
FIG. 19 illustrates a side view of an automatic stair way with a filled void space and a first spring that couples the uppermost run stair with the horizontal stair flights, according to an embodiment herein.
Figure 19A:
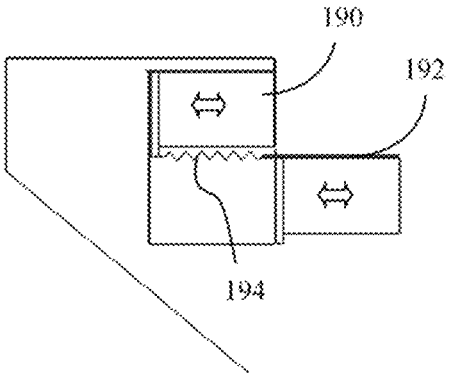
FIGS. 19A, 19B, and 19C illustrate a side view of an automatic stair way indicating the various sequences of the filled void space and the first spring, according to an embodiment herein.
Figure 19B:
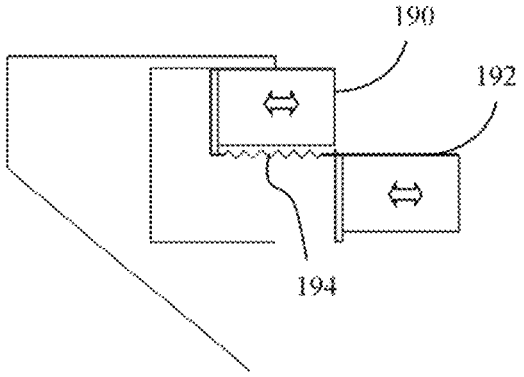
Figure 19C:
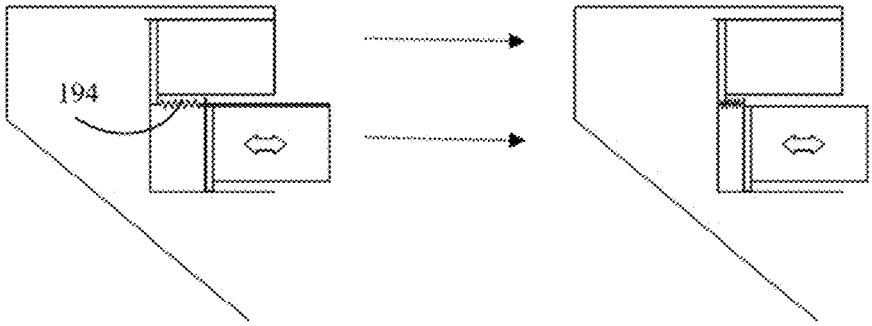

FIG. 19 illustrates the filled void space 191 and a first spring 194 which couples the uppermost run stair with the horizontal stair flights 192. The uppermost run stair 190 is constraint to the stair flight 192 in horizontal direction and a spring is provided to couple the run stair 190 with the stair flights 192. When the run stair 190 collides with the wall 193, the movement reaches to an end while the stair flight 192 continues its backward motion/movement thereby compressing the spring 194. In this sequence, the backward motion/movement limitation of the uppermost run stair is reduced to one horizontal step. When the stair flights moves forward, the spring is expanded at the first horizontal step and the stair flights returns to its normal configuration, as illustrated in FIG. 19A-FIG. 19C. The spring (resilient) force of the spring 194 is greater than any possible force in horizontal direction and the actuator force is great enough to compress the spring 194 while moving the stair flights.

Figure 20:
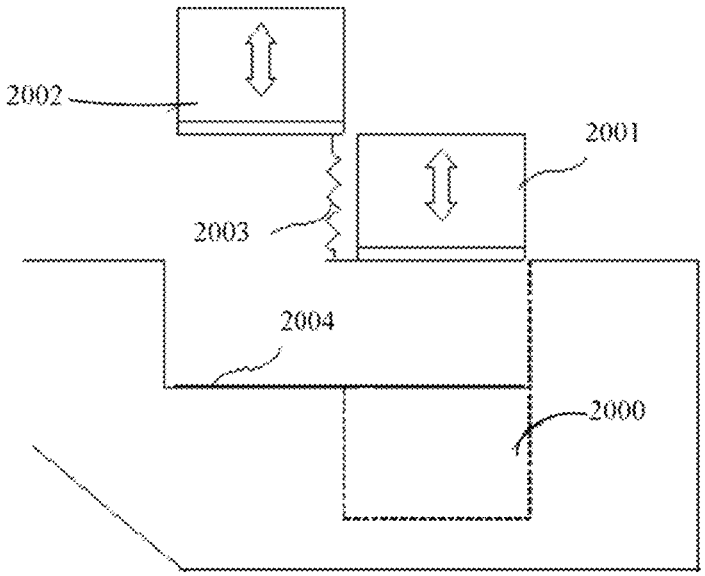
FIG. 20 illustrates a side view of an automatic stair way indicating a filled void space and a second spring which couples the lowermost vertical stair step with the vertical stair flights, according to an embodiment herein.
Figure 20A:
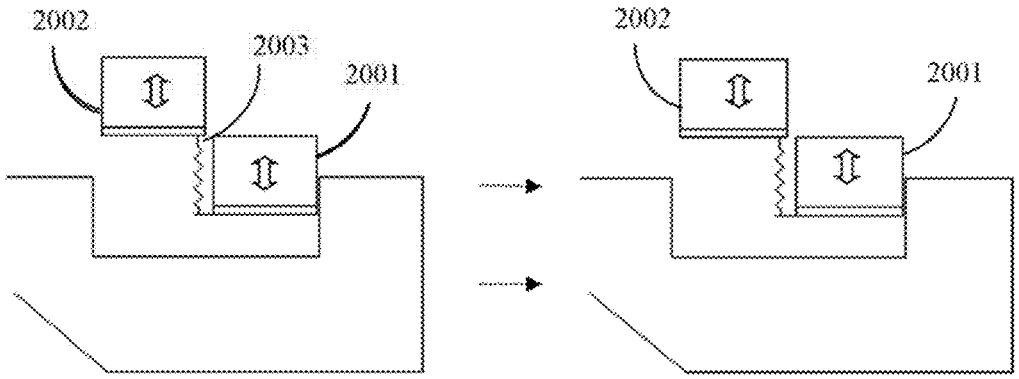
FIG. 20A-20B illustrates a side view of an automatic stair way indicating various sequences of the filled void space and the second spring, according to an embodiment herein.
Figure 20B:
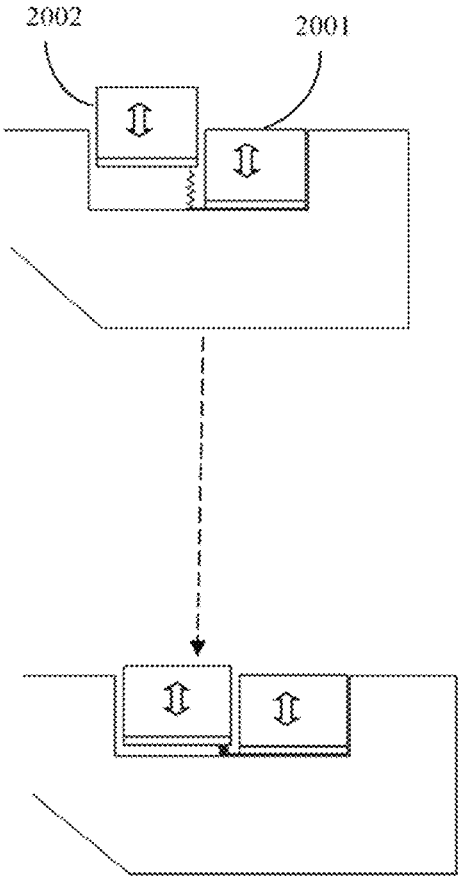

FIG. 20 illustrates the filled void space 2000 and a second spring 2003 which couples the lowermost vertical stair step 2001 with the vertical stair flights 2002. The lowermost stair step 2001 is constraint to the stair flight 2002 in vertical direction and a spring 2003 is provided to couple the stair step 2001 with the stair flights 2002. When the stair 2001 collides with the wall 2004, the motion/movement of the stair flight reaches to end and the stair flight 2001 continues the downward motion/movement thereby compressing the spring 2003. In this sequence, the downward motion/movement, the limit of the lowermost stair 2001 of the vertical stair flights 2002 is reduced to one vertical step. When the stair flights moves upward, the spring 2003 is expanded at the first vertical step and the stair flights returns to its normal configuration. The spring force is greater than any possible force in vertical direction and the actuator force is great enough to extract the spring 2003, as illustrated in FIG. 20A-FIG. 20B. As the gravity force acts as the retracting force in vertical direction, the spring is not necessarily required. The springs 193 and 2003 are replaced with similar retracting mechanism which is active or passive.

Figure 21:
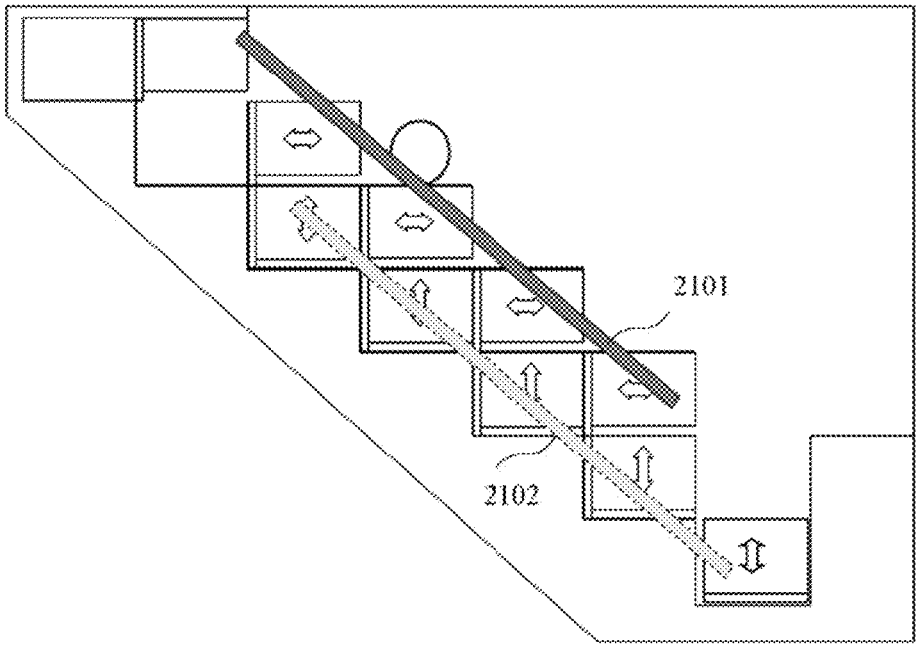
FIG. 21 illustrates a side view of an automatic stair way in which the first stair flights is fixed to a stringer at one side of the stairway and the second stair flights is fixed to another stringer at the opposite side of the stair way, according to an embodiment herein.

According to an embodiment herein, several methods are used to couple the stair flights to the stairway several solutions. Referring to the FIG. 21, the first stair flights is fixed to a stringer 2101 at one side of the stairway and the second stair flights is fixed to another stringer 2102 at the opposite side of the stair way. No interference occurs between two stringers 2101 and 2102. For structural stiffness, the stair flights are fixed to stringers at the two opposite sides.

It is to be noted that the configuration described above is an illustrative example for one embodiment of the present invention and skilled one in the related art can made numerous modification to the present invention without departing from the principles and the concepts of the present invention, as defined by the following claims.

Advantageously, the embodiments herein provide an automatic escalator to raise or lower payloads between different floors. The automatic escalator include two stair flights that transfer loads along the stairway by discrete sequential motions/movements. The automatic escalator with a first stair flights is configured to move in horizontal direction and a second stair flight is configured to move in vertical direction. In scenarios where a payload needs to be transferred up and down, the conventional escalators with conveyor belt are not used. Thus, the automatic escalator disclosed herein provides an improved design of escalator that is used to raise and lower payloads between different floors.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modifications.

Although the embodiments herein are described with various specific embodiments, it will be obvious for a person skilled in the art to practice the embodiments herein with and without modifications.

What is claimed is:

1. An automatic straight stairway comprising:

a fixed frame for enclosing a stairs housing;

a first stair flight configured to move horizontally, and wherein the first stair flight includes a plurality of run stairs, and wherein each run stair comprises a plurality of vertical plates arranged at equal distance along a width of the stair in a comb-tooth structure;

a second stair flight configured to move vertically, and wherein the second stair flight comprises a plurality of rise stairs, and wherein each rise stair comprises a plurality of vertical plates in a comb-tooth structure, and wherein the second stair flight is designed to fit inside the first stair flight;

a stringer coupled to the fixed frame by linear joints, and wherein the stringer is affixed to the plurality of rise stairs, and wherein the stringer is configured to move along a horizontal direction;

a first spring coupling an uppermost stair step of the first stair flight to another stair steps of the first stair flight;

a second spring coupling a lowermost stair step of the second stair flight to another stair steps of the second stair flight, and wherein the second spring is designed to provide a relative vertical motion or movement of the stair steps of the second stair flight; and wherein the vertical motion or movement of the second stair flight causes a sequential motion or movement of the first stair flight and the second stair flight, thereby exchanging an arbitrary load between the first stair flight and the second stair flight.

2. The stairway as claimed in claim 1, wherein the stringer is configured to move along the horizontal direction using an electric motor and a power transmission mechanism.

3. The stairway as claimed in claim 1, wherein each rise stair is made of a plurality of parallel vertical plates that are arranged at equal distance along a width of the stair.

4. The stairway as claimed in claim 1, wherein the second stair flights are configured to move one or two vertical steps along a vertical direction without interference and collision with the first stair flights.

5. The stairway as claimed in claim 1, wherein the first stair flights are configured to move one or two horizontal steps along the horizontal direction without interference and collision with the vertical stair flights.

6. The stairway as claimed in claim 1, wherein the vertical parallel plates are rectangular in shape with dimension is proportional to the size of the rise stair.

7. The stairway as claimed in claim 1, wherein a height of the vertical plates of the second stair steps is higher than a height of the vertical plates of the first stair steps.

8. The stairway as claimed in claim 1, wherein a thickness of the vertical parallel plates of the first stair steps is less than a free space between the vertical plates of the second stair steps.

9. The stairway as claimed in claim 1, wherein a thickness of the vertical parallel plates of the second stair steps is less than a free space between the vertical plates of the first stair steps.

10. The stairway as claimed in claim 1, further comprises safety facilities or mechanism equipped at a nose portion or edge portion of each stair steps and at free spaces between the plurality of vertical plates.

11. The stairway as claimed in claim 1, wherein the plurality of run stairs and rise stairs are driven though an individual actuator and a control system that regulates the sequential motion of stair steps to transfer loads along the stairway.

* * * * *